US006341916B1

(12) United States Patent
Nettis et al.

(10) Patent No.: US 6,341,916 B1
(45) **Date of Patent: *Jan. 29, 2002**

(54) DEVICE FOR CONNECTING AT LEAST ONE LATH ELEMENT, AND RELATIVE BUILD-UP STRUCTURE

(75) Inventors: Francesco Nettis, Bari; Francesco Filippi, Lugo; Carmine Santarpia, Bitonto; Giuseppe Consiglio, Acquaviva, all of (IT)

(73) Assignee: Francesco Nettis (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/242,062

(22) PCT Filed: Aug. 8, 1997

(86) PCT No.: PCT/IT97/00208

§ 371 Date: Dec. 7, 1999

§ 102(e) Date: Dec. 7, 1999

(87) PCT Pub. No.: WO98/06301

PCT Pub. Date: Feb. 19, 1998

(51) Int. Cl.[7] ..... F16B 9/00
(52) U.S. Cl. ..... 403/171; 403/176

(58) Field of Search ..... 403/171, 170, 403/172, 176; 52/81.3, 655.1, 655.2, 656.7

(56) References Cited

U.S. PATENT DOCUMENTS

| | | | | | |
|---|---|---|---|---|---|
| 4,763,459 | A | * | 8/1988 | Wesselski | 403/171 X |
| 4,872,779 | A | * | 10/1989 | Imai | 403/171 |
| 5,310,273 | A | * | 5/1994 | Hara | 403/171 |
| 5,932,689 | A | * | 11/1998 | Culi | 52/656.9 |

* cited by examiner

*Primary Examiner*—Lynne H. Browne
*Assistant Examiner*—John R. Cottingham
(74) *Attorney, Agent, or Firm*—Hall, Priddy, Myers & Vande Sande

(57) ABSTRACT

A device (1; 1'; 13"; 100; 150; 170) for connecting at least one lath element (13'; 13"), the device (1; 1'; 13"; 100; 150; 170) being characterized by having a main outer body (2; 101) formed in one piece from a first material, and at least one resisting element (15; 102; 155; 174) having connecting means (10', 10", 11', 11", 12', 12"; 110, 111; 151*b*, 151*d*, 152*b*, 152*d*, 153*b*, 153*d*, 154*b*, 154*d*; 171*a*, 171*d*, 172*a*, 172*d*, 173*a*, 173*d*) for connecting the lath element (13'; 13"); the resisting element (15; 102; 155; 174) being defined by a number of parts (6, 7, 8; 151, 152, 153, 154; 171, 172, 173) substantially housed inside the main outer body (2; 101), and being made of a second material, other than the first material, for resisting mechanical stress.

20 Claims, 5 Drawing Sheets

Fig.5a
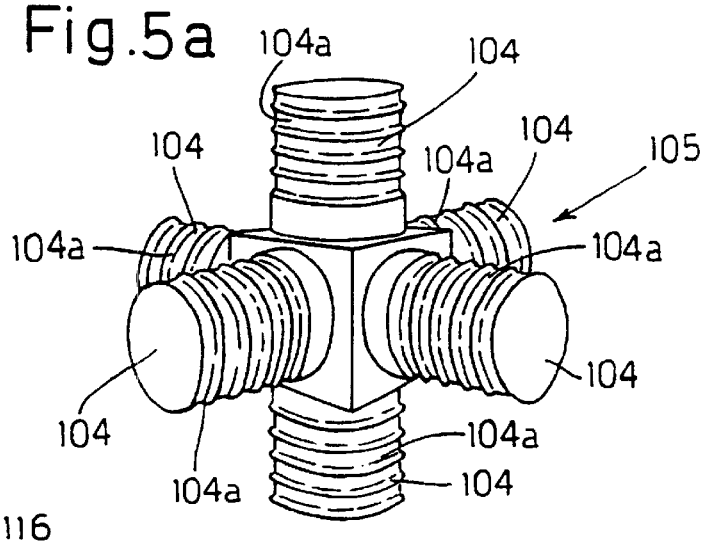
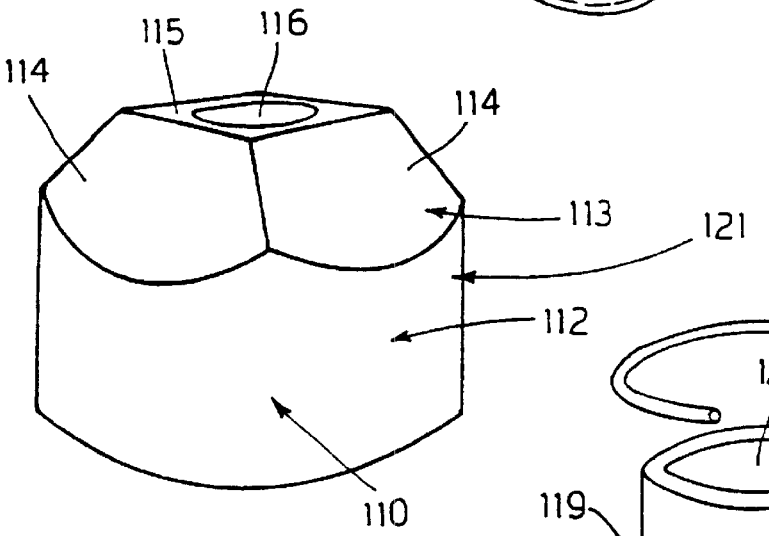
Fig.5b
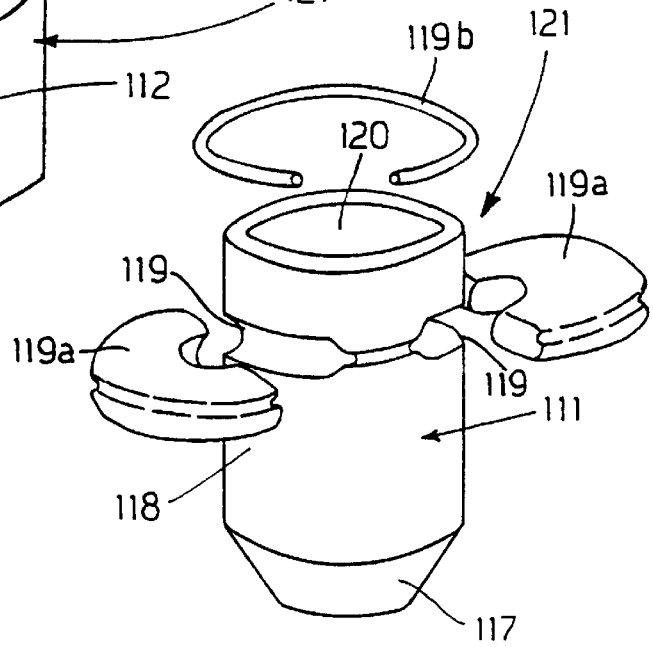
Fig.5c

DEVICE FOR CONNECTING AT LEAST ONE LATH ELEMENT, AND RELATIVE BUILD-UP STRUCTURE

TECHNICAL FIELD

The present invention relates to a device for connecting at least one lath element, and to the relative build-up structure.

BACKGROUND ART

In the furnishing and building industry in general, connecting devices are known for reversibly connecting two or more elements, the whole formed by the connecting devices and connected elements at times defining a build-up, in particular a modular build-up, structure.

German Patent Application DE-A-3 510 920 (Holdapp), for example, describes a connecting device for reversibly connecting horizontal lath elements to a vertical supporting element, and which substantially comprises a central metal ring from which holes, possibly threaded, radiate in four perpendicular horizontal directions and cooperate with fastening means embedded in the horizontal lath elements.

In DE-A-3 510 920, the metal ring is fitted to the vertical supporting element by tightening a vertical lock element, which, however, fails to provide for sufficient stability of the horizontal laths, due to any stress on the horizontal laths being transmitted to the metal ring and loosening the grip of the lock element on the ring, thus impairing the overall rigidity of the structure.

Another German Patent Application DE-A-4 327 628 (Scholze) describes a device for connecting two lath elements, which comprises a main outer body formed in one piece from a first material, and a bush substantially housed inside the main outer body and made of a second material other than the first. The bush, however, is formed in one piece comprising two perpendicular threads for receiving complementary connecting means on the two lath elements. A drawback of the connecting device described in the above application is that some screws engage through the wood, thus preventing the connection of lath elements having narrow sections.

DISCLOSURE OF INVENTION

It is an object of the present invention to eliminate the aforementioned drawbacks.

According to the present invention, there is provided a device for connecting at least one lath element, the device being characterized by comprising a main outer body formed in one piece from a first material, and at least one resisting element having connecting means for connecting said at least one lath element; said resisting element comprising a number of parts substantially housed in the main outer body, and being made of a second material, other than the first material, for resisting mechanical stress.

The connecting device according to the present invention provides for reliable connection of the lath elements in terms of mechanical strength, as well as for attractive appearance by ensuring continuity of the material between the lath elements and the main outer body.

Moreover, the resisting element housed substantially inside the main outer body may be broken down easily into its component parts, which may be used to form connecting means in 2–6 perpendicular directions as required by the user.

Depending on the type of resisting element used, the connecting devices may either be formed in the factory or supplied by the maker in kits for on-the-spot assembly.

BRIEF DESCRIPTION OF THE DRAWINGS

A number of non-limiting embodiments of the present invention will be described by way of example with reference to the accompanying drawings, in which:

FIG. 5*a* is a perspective large-scale view of a pin structure employed in the embodiment of FIG. 4.

FIG. 5*b* is a perspective side view of a bell component employed in the embodiment of FIG. 4.

FIG. 5*c* is a perspective exploded view of a connecting element employed in the embodiment of FIG. 4.

BEST MODE FOR CARRYING OUT THE INVENTION

Figure 1A:
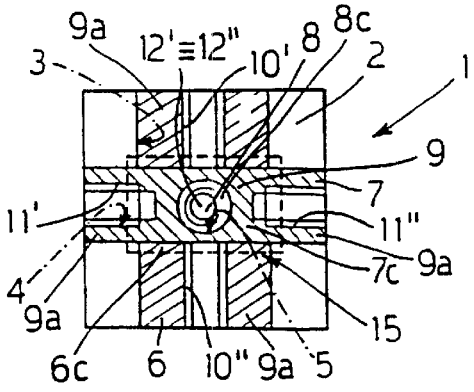
FIG. 1*a* shows a section of a first embodiment of the connecting device according to the present invention.

Number 1 in FIG. 1*a* indicates the connecting device as a whole for connecting at least one lath element (not shown in FIG. 1*a*).

Figure 1B:
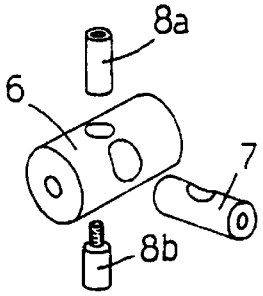
FIG. 1*b* is an exploded perspective view of a brush as used in the embodiment of FIG. 1*a*.
Figure 2:
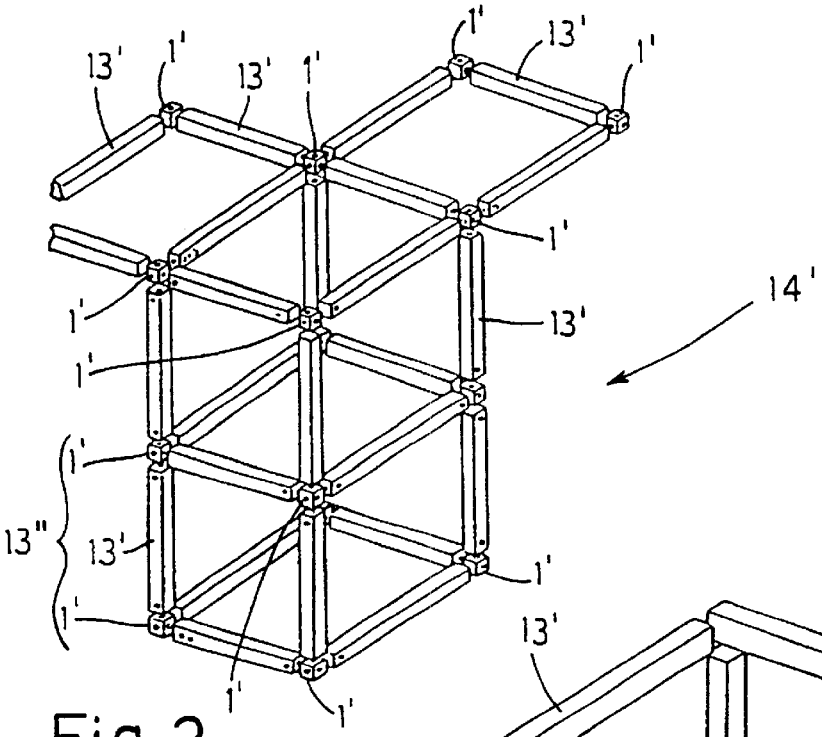
FIG. 2 shows the FIG. 1 connecting device in conjunction with a number of lath elements for forming a build-up, in particular a modular build-up, structure.

Connecting device 1 in the first embodiment shown comprises a main outer body 2 (e.g. advantageously made of wood, plastic or glass) in turn comprising three through holes 3, 4, 5, which may be combined with respective bushes 6, 7, 8 (FIG. 1*b*) to form a spiderlike resisting element 15. Bushes 6, 7, 8 are in turn so formed that the central portions 6*c*, 7*c*, 8*c*, when fitted one inside the other, form a central core 9 for resisting any mechanical stress generated by and on the lath elements; and the portions of bushes 6, 7, 8 not forming part of core 9 define a number of arms 9*a*, perpendicular or not, comprising connecting means for connection to complementary connecting means on the lath elements 13' (FIG. 2). More specifically, and as shown in FIG. 1*b*, bushes 6 and 7 are each formed in one piece, whereas bush 8 comprises two portions 8*a*, 8*b* which are screwed together. Bushes 6, 7, 8 may advantageously be made of metal, in particular steel or aluminium, and each comprise at the ends respective female elements 10', 10"; 11', 11"; 12', 12" defining the connecting means for connection to the complementary connecting means (not shown in FIG. 1) on the lath elements (not shown in FIG. 1) combined with device 1.

To anyone skilled in the art, it will be clear that female elements 10', 10"; 11', 11"; 12',12" may be replaced by any male element for connecting device 1 to at least one lath element.

FIG. 2 shows a number of devices 1' combined with a number of lath elements 13' to form a build-up structure 14', which may be used, for example, as the supporting structure of a piece of furniture (not shown), and which may comprise lath elements 13' of different lengths.

Series of devices 1' combined with series of lath elements 13' may also be devised for forming modular structures 14' for any application.

In FIG. 2, devices 1' provide for connecting at least two lath elements 13', which comprise, at the ends, complementary connecting means, in particular male means (not shown in FIG. 2), for connection to female elements 10', 10"; 11', 11"; 12', 12" of respective devices 1'.

It should be pointed out that, herein, a "build-up" element is intended to mean an element which may be connected to others to form a more complex structure; whereas a "modular" structure is intended to mean a structure comprising individual elements of the same size, or which are proportional to or multiples of one another.

Figure 3:
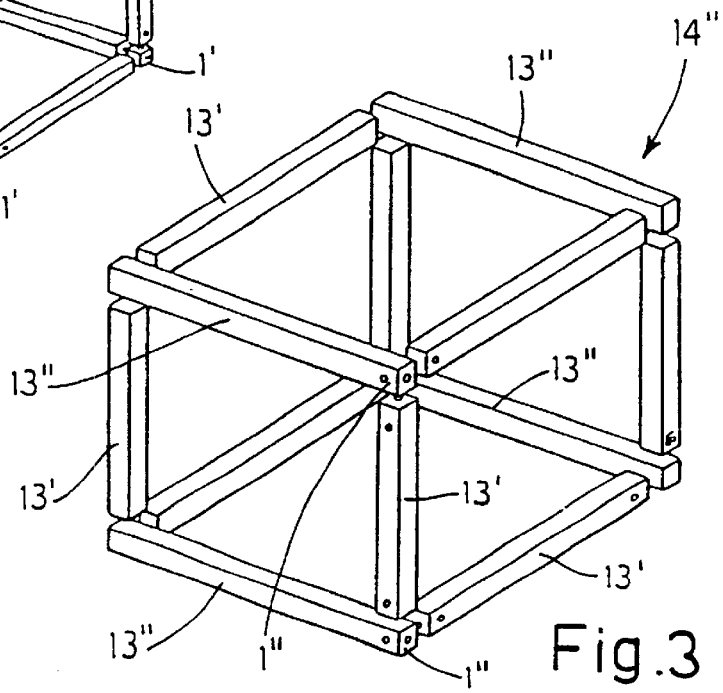
FIG. 3 shows the FIG. 1 device formed in one piece with a respective lath element forming part of a build-up structure.

FIG. 3 shows a build-up structure 14" comprising both lath elements 13' and 13", and wherein lath elements 13" house (at the ends) respective connecting devices 1' defining connecting means for direct connection to other lath elements 13", or for indirect connection to lath elements 13' via the interposition of respective connecting devices 1'.

Figure 4:
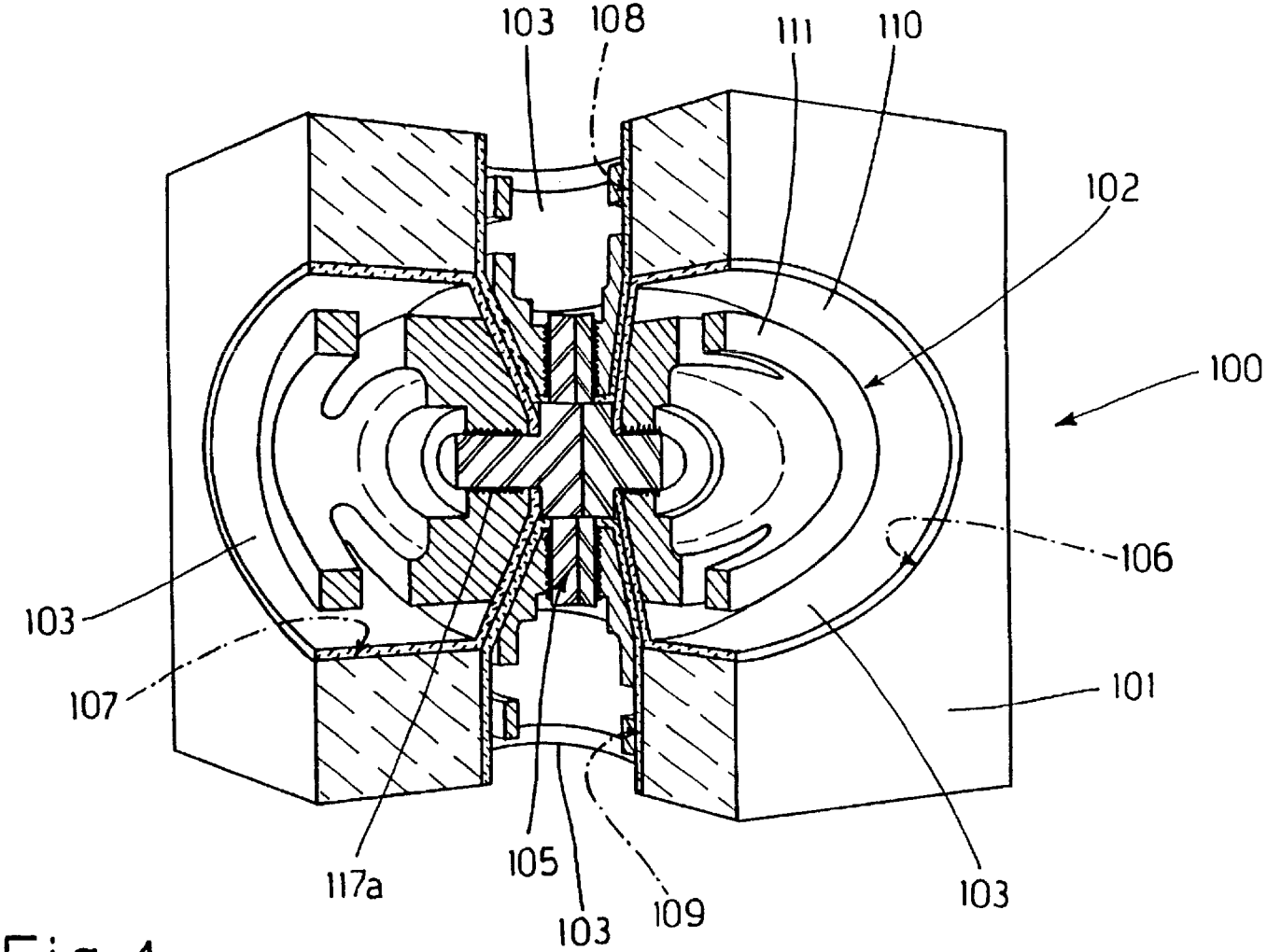
FIG. 4 shows a view, with parts removed for clarity, of a second embodiment of the connecting device according to the present invention.

FIGS. 4 and 5 show a second embodiment of the present invention.

In this case, the connecting device, here indicated 100, comprises a main outer body 101, and a number of parts 103 defining a spider 102.

Each part 103 of spider 102 comprises a pin 104 (FIG. 5*a*) with connecting means described in detail later on; and pins 104 combine to form a central core 105 of spider 102 (FIG. 5*a*), extend in respective perpendicular directions from a central body, and comprise respective threads 104*a*.

Main outer body 101 comprises a number of holes 106, 107, 108, 109 of such a diameter as to permit smooth insertion of respective component parts 103 of spider 102 inside main outer body 101.

Each part 103 may be thought of as ideally comprising a pin 104 (even though connected integrally to the other pins 104 to form core 105), a respective bell 110 (FIG. 5*b*), and a respective connecting element 111 (FIG. 5*c*). Bell 110 and respective connecting element 111 define a respective arm 121 of spider 102; bell 110 comprises a cylindrical first portion 112 connected to a truncated-pyramid-shaped second portion 113, the flat lateral faces 114 of which rest on the similar faces 114 of adjacent bells 110; and the top face 115 of truncated-pyramid-shaped second portion 113 comprises a through hole 116 slightly larger in diameter than pins 104 of core 105.

As shown in FIG. 4, truncated-pyramid-shaped portion 113 of bell 110 comprises a truncated-cone-shaped inner surface, and supports a respective truncated-cone-shaped portion 117 of a respective connecting element 111 (FIG. 5*c*), which also comprises a further cylindrical portion 118 having through seats 119 for receiving tabs 119*a* retained elastically by a retaining ring 119*b*. The respective inner surfaces of tabs 119*a* mate stably with advantageously skittle-shaped complementary connecting means (not shown in FIG. 5*c*) inserted inside an opening 120; and truncated-cone-shaped portion 117 of connecting element 111 comprises an internal thread 117*a* engaged by thread 104*a* formed on respective pin 104 of core 105.

Assembly of core 105, bells 110 and connecting elements 111 defining arms 121 is clearly understandable from FIG. 4:

(A) Firstly, core 105—which, as stated, is of such a size as to permit smooth insertion into main outer body 101—is inserted through each of holes 106–109.

(B) A bell 110 is inserted inside each of holes 106–109 in main outer body 101, so that a pin 104 of core 105 is fitted through hole 116 in the top face 115 of bell 110, and therefore projects inside bell 110; and (C) A connecting element 111 is inserted inside respective bell 110 and screwed onto respective pin 104 of core 105 to tighten bell 110 inside respective hole 106–109 and against the other adjacent bells 110.

In other words, faces 114 of truncated-pyramid-shaped portion 113 of each bell 110 rest on faces 114 of the adjacent bells 110. In this case, too, core 105, bells 110 and connecting elements 111 may be made of metal, in particular steel or aluminium.

Figure 6:
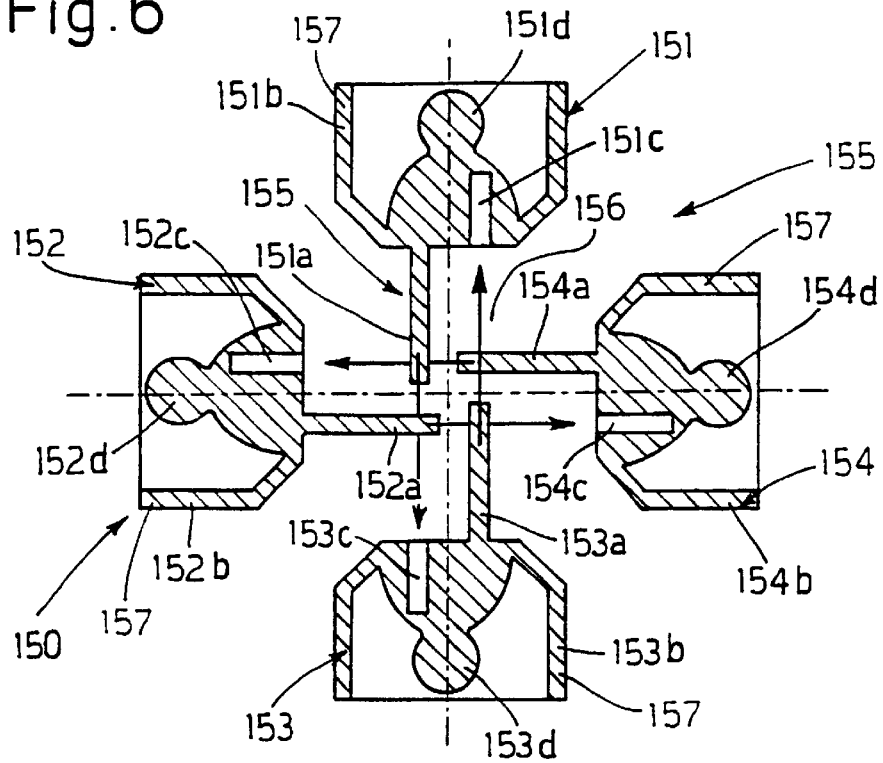
FIG. 6 shows a third embodiment of the present invention.

FIG. 6 shows a third embodiment of the present invention.

For the sake of clarity, FIG. 6 does not show the main outer body, which, however, may be identical to body 2 in FIG. 1 or body 101 in FIG. 4.

In this case, the connecting device, here indicated 150, comprises a main outer body (not shown); and a spider 155 made of different material from the main outer body, and in turn comprising a number of parts 151, 152, 153, 154. In this case, core 156 of spider 155 comprises a number of pins 151*a*, 152*a*, 153*a*, 154*a* integral with the bottom of respective bells 151*b*, 152*b*, 153*b*, 154*b*, and which are forced inside respective seats 153*c*, 154*c*, 151*c*, 152*c* formed in the bottom of respective bells 153*b*, 154*b*, 151*b*, 152*b*.

In the FIG. 6 embodiment, pin 151*a* is obviously forced inside seat 153*c* formed in the bottom of the opposite bell 153*b*, and likewise for all the other pins. The concave portions of bells 151*b*, 152*b*, 153*b*, 154*b* house respective skittles 151*d*, 152*d*, 153*d*, 154*d*, which, together with respective bells 151*b*, 152*b*, 153*b*, 154*b*, define respective arms 157 comprising connecting means engaged by complementary connecting means on the lath elements (not shown in FIG. 6). In other words, skittles 151*d*, 152*d*, 153*d*, 154*d* in this embodiment perform the same function as connecting elements 111 in the FIG. 4 and 5*c* embodiment.

It is important to note that, in the FIG. 6 embodiment, the bottom of bells 151*b*, 152*b*, 153*b*, 154*b* is substantially truncated-cone-shaped, and devices 150 may be formed with a core 156 comprising two, four or six pins 151*a*, 152*a*, 153*a*, 154*a*. Obviously, if only skittles 151*d* and 152*d*, for example, are to be used, holes 106–109 corresponding to skittles 153*d* and 154*d* may either be plugged during manufacture of device 150, or not formed at all in the main outer body (FIG. 4).

Figure 7A:
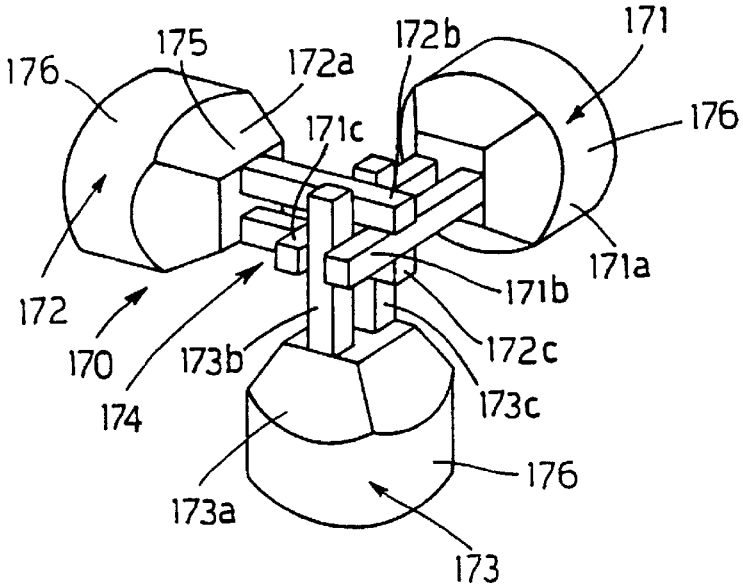
FIG. 7*a* is a perspective view of another embodiment of this invention.
Figure 7B:
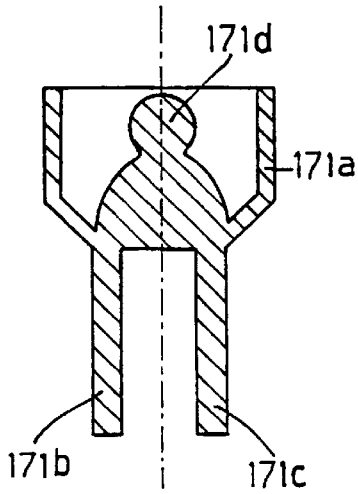
FIG. 7*b* is a side sectional view of element 171 as shown in FIG. 7*a*.

The fourth embodiment in FIG. 7 is similar to the one in FIG. 6, and shows a connecting device 170 comprising a main outer body (not shown for the sake of simplicity), and a spider 174 in turn comprising parts 171, 172, 173. Core 175 is defined by substantially fork-shaped pairs of pins 171*b*, 171*c*; 172*b*, 172*c*; 173*b*, 173*c* integral with the bottom of respective bells 171*a*, 172*a*, 173*a*, and which engage the corresponding perpendicular pairs of pins 171*b*, 171*c*; 172*b*, 172*c*; 173*b*, 173*c* integral with adjacent bells 171*a*, 172*a*, 173*a*. As before, bells 171*a*, 172*a*, 173*a* may also house respective skittles 171*d*, 172*d*, 173*d* (only one shown in FIG. 7*b*), which, together with respective bells 171*a*, 172*a*, 173*a*, define respective arms 176 of spider 174 for mating with complementary connecting means on the lath elements.

Obviously, to prevent detachment, the tightness provided for in the FIG. 6 and 7 embodiments is calculated as a function of the axial load produced on each pair of pins 171*b*, 171*c*; 172*b*, 172*c*; 173*b*, 173*c* by the respective lath element.

In particular, in the FIG. 6 and 7 embodiments, provision may be made for injecting appropriate resins into the main outer body, through the holes formed in the body, to lock the component parts of the spider stably to one another and to the body.

Figure 8:
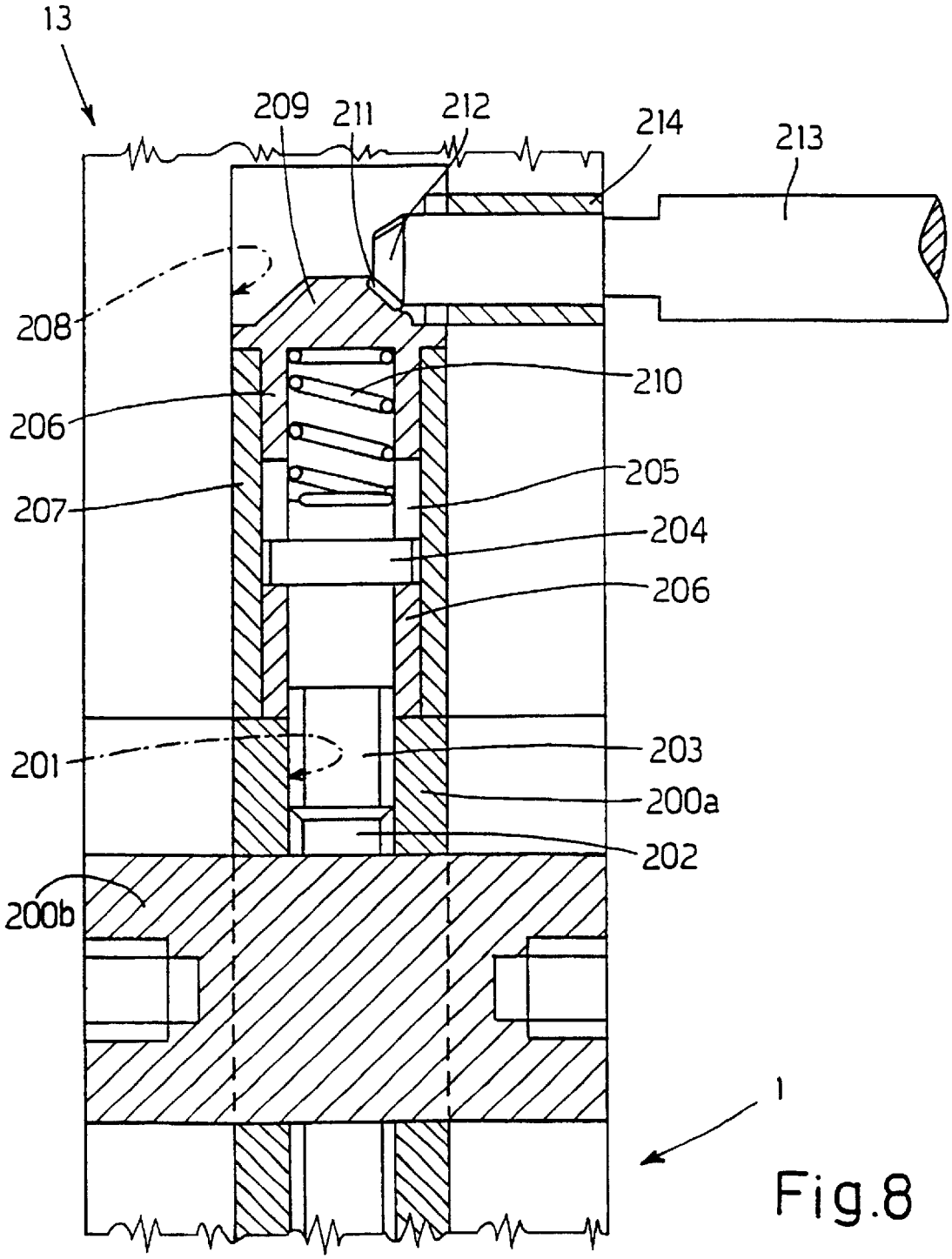
FIG. 8 shows connecting means, complementary connecting means and fastening means which may be combined with the connecting device according to the present invention.

FIG. 8 shows, purely by way of example, connecting, complementary connecting, and fastening means which may be applied to the device according to the present invention.

More specifically, in FIG. 8, the connecting, complementary connecting, and fastening means are applied to a connecting device 1 integral or not with a first lath element (FIGS. 2, 3) and connected to a second lath element 13.

The bushes, here indicated 200*a*, 200*b*, are conventional types identical to those described with reference to FIG. 1; a threaded hole 201 is engaged by the threaded head 202 of a cylindrical male element 203 comprising, at the other end, a pin 204, the projecting portions of which are free to slide vertically inside a longitudinal opening 205 formed in a tubular element 206; and tubular element 206 rotates freely inside a tubular bush 207 inserted tightly inside a seat 208 on lath element 13.

Tubular element 206 is closed at the innermost end by a projecting disk 209 resting on the edge of tubular bush 207; a normal coil spring 210 presses at one end on the inner face of disk 209, and rests at the other end on male element 203; and a gear 211 extends from disk 209 inside seat 208, and meshes with a bevel pinion 212 forming part of a tubular tool 213 inserted inside a guide 214.

When turned in a first direction, tool 213 turns disk 209 to rotate male element 203, so that the threaded head 202 of male element 203, which also travels vertically by virtue of opening 205, engages threaded hole 201 of bush 200*a* to bring together and tighten the two supporting elements. Conversely, when turned in the opposite direction, tool 213 releases lath element 13 and connecting device 1.

Clearly, changes may be made to the connecting device as described and illustrated herein without, however, departing from the scope of the present invention.

What is claimed is:

1. A device for connecting at least one lath element, the device comprising a block of a first solid material comprising a main body, and at least one resisting element having connecting means for connecting said at least one lath element; said at least one resisting element comprising a number of parts substantially housed in said block, and being made of a second solid material, other than the first solid material, for resisting mechanical stress;

wherein said block of solid material includes holes on each side, so that at least one hole is bigger than the overall dimension of a core which is introduced into said block, and wherein arms are attached to said core, previously introduced into said block in order to obtain a spiderlike resisting element.

2. A device as claimed in claim 1, wherein said core is formed in one solid piece.

3. A device as claimed in claim 1, wherein said core comprises a number of separable portions.

4. A device as claimed in claim 2 or 3, wherein said connecting means are housed entirely in said main outer body.

5. A device as claimed in claim 2, wherein said core comprises a number of elements having means for connection to said arms.

6. A device as claimed in claim 5, wherein each of said arms comprises a bell and a connecting element separate from each other.

7. A device as claimed in claim 6, wherein said connecting element comprises through seats for receiving respective tabs retained elastically by a retaining ring; the respective inner portions of said tabs mating stably with complementary connecting means fitted through an opening.

8. A device as claimed in claim 1, wherein each of said arms compr ises a bell connected stably to a respective skittle.

9. A device as claimed in claim 7, wherein each element constituting said core is inserted tightly inside a corresponding seat formed in the bottom of the respective bell.

10. A device as claimed in claim 3, wherein each first pair of portions constituting said core mates tightly with a corresponding second pair of portions perpendicular to said first pair of portions.

11. A device as claimed in claim 3, wherein said parts fit one inside the other to form a core and a number of arms.

12. A device as claimed in claim 1, wherein said main outer body is substantially in the form of a cube; and wherein the sides of said main outer body are of a length equal to the thickness of said at least one lath element.

13. A device as claimed in claim 1, wherein one face of said main outer body contacts one end of said at least one lath element.

14. A device as claimed in claim 1, wherein said at least one resisting element is made of metal.

15. A device as claimed in claim 1, wherein said main outer body is substantially parallelepiped to define a lath element.

16. A device as claimed in claim 1, wherein said at least one lath element has a circular or square or rectangular cross section.

17. A build-up structure characterized by comprising a number of connecting devices as recited in claim 1 in combination with more than one said lath element.

18. A build-up structure as claimed in claim 17, characterized by being modular.

19. A build-up structure as claimed in claim 18, wherein said connecting device comprises, internally, said connecting means, whereas said lath element comprises, internally, complementary connecting means and tightening means.

20. A build-up structure as claimed in claim 19, wherein said tightening means comprise a bevel coupling.

* * * * *